US008632106B2

(12) United States Patent
Nass et al.

(10) Patent No.: US 8,632,106 B2
(45) Date of Patent: Jan. 21, 2014

(54) DRIVE UNIT COMPRISING A BLOCKED FUNCTIONAL ELEMENT FOR A CENTRAL LOCKING MECHANISM

(75) Inventors: Ulrich Nass, Mülheim (DE); Johannes-Theodor Menke, Velbert (DE); Frank Kunt, Lüdinghausen (DE); Lars Kretschmer, Jüchen (DE); Philippe Mih, La Wantzenau (FR)

(73) Assignee: Kiekert AG, Heiligenhaus (DE)

( * ) Notice: Subject to any disclaimer, the term of this patent is extended or adjusted under 35 U.S.C. 154(b) by 332 days.

(21) Appl. No.: 13/056,166

(22) PCT Filed: Aug. 6, 2009

(86) PCT No.: PCT/DE2009/001133
§ 371 (c)(1),
(2), (4) Date: Jan. 27, 2011

(87) PCT Pub. No.: WO2010/020217
PCT Pub. Date: Feb. 25, 2010

(65) Prior Publication Data

US 2011/0167882 A1 Jul. 14, 2011

(30) Foreign Application Priority Data

| | | |
|---|---|---|
| Aug. 22, 2008 | (DE) | 10 2008 039 239 |
| Nov. 5, 2008 | (DE) | 10 2008 056 055 |
| May 8, 2009 | (DE) | 10 2009 020 488 |

(51) Int. Cl.
*E05C 3/06* (2006.01)
*E05C 3/16* (2006.01)

(52) U.S. Cl.
USPC .... 292/201; 292/279; 292/280; 292/DIG. 57; 292/DIG. 73

(58) Field of Classification Search
USPC ..... 292/201, 279, 280, DIG. 56, DIG. 57, 292/DIG. 73; 74/89.14, 421 A, 405, 425
See application file for complete search history.

(56) References Cited

U.S. PATENT DOCUMENTS

| | | | | |
|---|---|---|---|---|
| 4,006,646 | A * | 2/1977 | F'Geppert | 74/425 |
| 4,367,660 | A * | 1/1983 | Becker et al. | 74/625 |
| 5,520,426 | A * | 5/1996 | Arabia et al. | 292/337 |
| 5,639,130 | A * | 6/1997 | Rogers et al. | 292/216 |
| 5,697,237 | A * | 12/1997 | Dilger et al. | 70/264 |
| 5,746,076 | A * | 5/1998 | Inoue | 70/277 |
| 5,938,253 | A * | 8/1999 | Szablewski et al. | 292/216 |
| 6,338,508 | B1 * | 1/2002 | Kleefeldt | 292/201 |

(Continued)

FOREIGN PATENT DOCUMENTS

| | | |
|---|---|---|
| EP | 1 101 890 A2 | 5/2001 |
| FR | 2 852 993 A1 | 10/2004 |
| GB | 2 112 443 A | 7/1983 |

*Primary Examiner* — Carlos Lugo
(74) *Attorney, Agent, or Firm* — Renner, Otto, Boisselle & Sklar, LLP

(57) ABSTRACT

A drive unit (1) comprising at least one electric drive motor (2) that moves a functional element (3), wherein the functional element (3) assumes, during its movement, a stop position (4) for switching off an electric drive motor (2), and at least one frictional element (6) cooperating with the functional element (3), wherein the frictional element (6) is disposed along a segment of a motion pathway (5) before the functional element (3) reaches the stop position (4). In addition, a motor vehicle lock (10) having a central locking mechanism (11) with such a drive unit (1).

16 Claims, 4 Drawing Sheets

(56) References Cited

U.S. PATENT DOCUMENTS 6,659,515 B2 * 12/2003 Raymond et al. ..... 292/201
6,712,407 B2 * 3/2004 Duriez ..... 292/201
7,028,573 B2 * 4/2006 Inaba et al. ..... 74/409
7,090,264 B2 * 8/2006 Dzurko et al. ..... 292/337
2006/0284426 A1 12/2006 Bigazzi et al.

* cited by examiner

DRIVE UNIT COMPRISING A BLOCKED FUNCTIONAL ELEMENT FOR A CENTRAL LOCKING MECHANISM

CROSS-REFERENCE TO RELATED APPLICATIONS

This is a National Stage Application of International Patent Application No. PCT/DE2009/001133, with an international filing date of Aug. 6, 2009, which is based on German Patent Application No. 10 2008 039 239.1, filed Aug. 22, 2008, on German Patent Application No. 10 2008 056 055.3, filed Nov. 5, 2008, and on German Patent Application No. 10 2009 020 488.1, filed on May 8, 2009.

BACKGROUND OF THE INVENTION

1. Field of the Invention

The invention relates to a drive unit comprising at least an electric drive motor, actuates a functional element, wherein the functional element comprises a stop position for turning off the electric drive motor during its movement.

The invention finds particular application in motor vehicle door locks, wherein the drive unit is, for example, part of a central locking system. Thus, a motor vehicle door lock can be provided with a central locking system having an electronic control unit. In this case, the locking lever is implemented as a central lever. The usual drive unit function is such that when the locking lever is in a locked position, the impact of the (external) operating lever corresponds to an idle stroke. A suitable explanation is found, for example, in EP 1101890 A2. That disclosure is incorporated herein by reference in its entirety.

2. Brief Description of the Related Art

In electric motor drive units, in particular, a rotary member used as a functional element, e.g., a gear wheel, can be actuated. The functional element is not normally self-restrained, but rather it turns unrestrained around an axis. The functional element can actuate levers that assume latched positions. It is thus possible to link the operation of an electric drive motor with the movement of a functional element. In particular, it is possible that the electric drive motor stops when the self-induced motion of the functional element is no longer possible, for example, because it has reached a predetermined latched position (a so-called block mode).

In such drive units, this mode sometimes leads to an increased load on the drive motor, which can cause additional noise. Due to free play between various parts of a motor vehicle door lock, it is difficult to clearly determine the interactions among the components in their various positions and/or to maintain the positions during operation of the motor vehicle.

On this basis, it is the task of the present invention to solve the prior art problems, at least partially.

BRIEF DESCRIPTION OF THE INVENTION

The present invention provides a drive unit, including one or more of the features hereinafter described in respect of several advantageous embodiments. It is noted that individually listed features may be combined in any technologically sensible way and to show further embodiments of the invention. The description and the figures together provide additional detailed descriptions of the invention and the preferred embodiments.

The drive unit described herein comprises at least one electric drive motor that moves the functional element, wherein the functional element assumes, during its movement, a stop position for switching off the electric drive motor and at least one frictional element cooperating with the functional element. The frictional element is disposed along a segment of the motion pathway before the functional element reaches the stop position. The friction coefficient between the frictional element and the functional element is such that the frictional force between the functional element and the frictional element cannot be overcome by forces that normally act on the functional element when the drive motor is turned off, at least along that segment of the motion pathway.

In other words, before reaching the stop position, at the stop position, and after leaving the stop position, a frictional force acts on the functional element such that the free movement of the functional element is slowed down or hindered along that segment of the motion pathway. In principle, the frictional force may be constant during contact, but this is not mandatory. As explained above, in the event that the engine loses power after the functional element has reached the stop position, the functional element may partially move backwards. However, this is not desirable. Therefore, a frictional element is provided that hinders (preferably only) this return movement. For example, the friction coefficient is set such that the functional element passes over the frictional element without significantly impairing movement when the (electrical) drive unit is active. However, the return movement of the functional element is significantly hindered when the (electrical) driving force is absent.

In addition, it is considered advantageous if the functional element is a rotational member. The rotational component may be a toothed wheel or a worm wheel, such that a suitable engagement mechanism is provided along the circumference.

Furthermore, it is proposed that the frictional element is disposed on one side surface of the rotational member. In this context, the two side surfaces can be used to move other levers, such as, e.g., the central locking lever. Preferably, on the opposite side surface, the rotational member has a shape or surface that is suitable for contacting the external frictional element. The functional element and frictional element are preferably made of plastic.

The frictional element may be formed along with a lateral projection of the functional element. This means that a protruding area of the functional element is formed such that it can interact with the external frictional element. The frictional element can be a separate component and/or can be formed as part of the housing. Additionally, the friction element can be a projection or a protruding element.

The lateral projection of the rotational element is preferably an element selected from the following group: a rib, a cam, a wing, or a beam with a recess. The rib may be straight and/or bent. The cam may form, in particular, a spherical surface for the frictional element. In addition, the wing also provides a complex contact surface for the frictional element such that, if necessary, various frictional forces may be produced upon contact with the projection of the frictional element. In addition, beams can be provided with recesses, wherein, for example, a recess comprises a seat or a guide for the frictional element. With respect to ribs, cams, wings, and the like, a common friction surface may be formed. However, with respect to a beam with a recess, it is also possible that the functional element is contacted on two sides with the frictional element.

Alternatively, the frictional element may be positioned below and/or above the rotational member and, in that position, it can act on the functional element with a frictional force in close proximity to slow down or block the movement of the functional element.

In a preferred embodiment of the invention, the frictional element is a resilient member, e.g., a spring washer, which is disposed below the rotational member. Thus, the drive unit may be operated with increased friction provided by the resilient member. When the drive is switched off, it possesses a relatively high self-restraint due to increased friction. The friction is especially applied in the direction opposite the drive's motion, making its return difficult. The drive unit must also work against a certain frictional force during its normal operation, without having to rely on additional components or devices. This frictional force is particularly strong once the drive is switched off.

In a particular embodiment of the invention, the drive unit is equipped with two separately formed frictional elements. Depending on the type of functional element and/or its movement, two separate frictional elements may be provided to restrict the return movement as much as possible (in many different stop positions) or to ensure that two frictional elements work independently from one another or complement one another. The frictional elements may be of the same type, e.g., a kind of two-part frictional element above and below the rotational member, or of different types that supplement one another.

Such a sole or additional solution is provided, for example, by integrating the frictional element into the housing of the drive unit. This eliminates the additional arrangement of a special unit in that the geometry of the housing is exploited and/or facilitates arrangement of additional installations in the form of friction brakes, which have the intended effect of limiting or preventing the return movement.

Specifically, the frictional element may be integrated into the lid and/or the main plate of the housing. For this purpose, an elevation or a special installation is provided in the area of the lid and/or bottom of the housing to prevent the return of the drive via a suitable frictional force. A single part, a multi-part lid, or a main plate of the housing may be used.

Also provided is a method for triggering a mechanism for opening a component of a locking mechanism of a motor vehicle lock comprising the use of the inventive drive unit described above. Components of a locking mechanism may be used to secure vehicle doors and/or vehicle hatches in defined closed positions. The mechanism for opening a component of a locking mechanism is triggered, e.g., when the functional element of the drive unit pivots a pawl of the locking mechanism from a locked position. Here, the functional element can pivot the pawl pivot either through an intermediate mechanism or by direct contact. Furthermore, according to the invention, the functional element may itself be provided in the form of a pawl. This procedure can be implemented independently from the specific design of the drive unit, i.e., the electromechanical actuation of the pawl, which may be beneficial. Independent implementation may be achieved using the following device: a lock arrangement comprising a locking mechanism with at least one catch and at least one pawl, which blocks the movement of the catch in the closed position, wherein the at least one pawl is electrically actuatable (by means of an electric motor and, where appropriate, via the functional element), in particular, such that it is moved away from the catch.

In particular embodiments of the invention, the motor vehicle lock is implemented as an electrically openable lock and/or a side-door lock.

The invention is particularly characterized in that a drive unit is provided with a functional element to which one or more frictional elements are assigned such that a reliable and secure return of the drive unit can be prevented or excluded after it is turned off. Depending on the setting of the frictional element and the frictional coefficient, the return movement is hindered or, if necessary, even eliminated. It is possible to operate the drive system such that it works against an increased friction. For example, when the drive is turned off, the friction reaches a maximum, imposes a high self-restraint, and prevents or minimizes a return movement.

Further details and advantages of the invention will be apparent from the following description and the accompanying drawings, which show a preferred embodiment with the necessary details and individual parts.

DETAILED DESCRIPTION OF THE INVENTION

Figure 1:
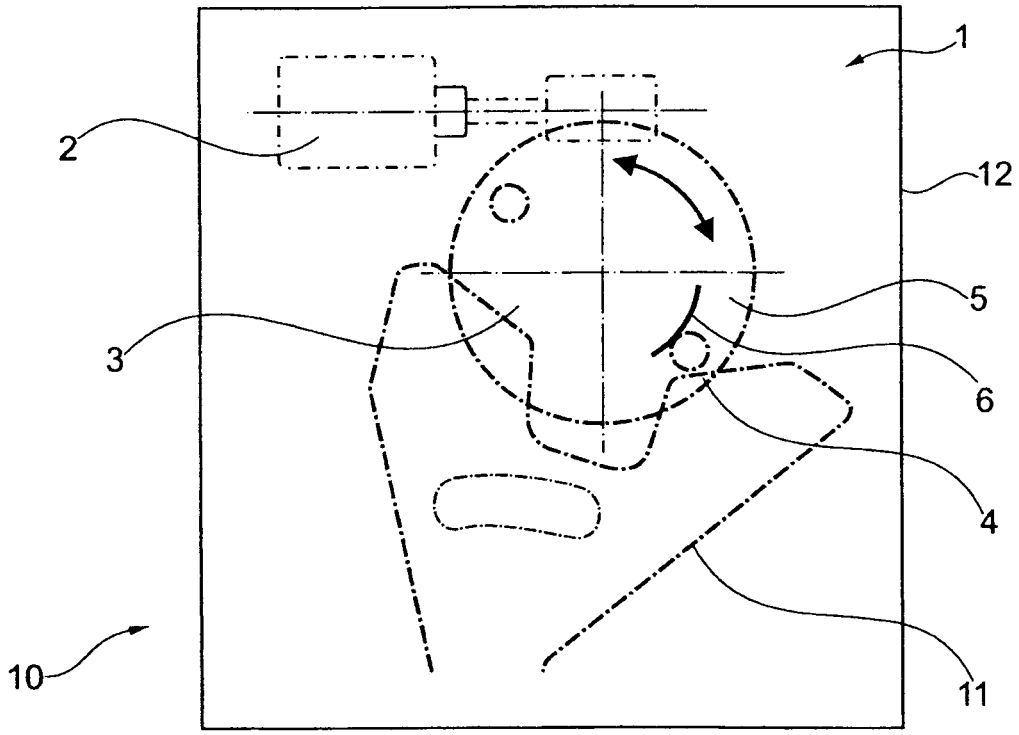
FIG. 1 shows a detail of a motor vehicle lock with a central locking mechanism.

FIG. 1 shows a schematic diagram of a motor vehicle lock 10 in a housing 12. Partially shown is a central locking mechanism 11, which is actuated by a functional element 3. Actuation is achieved via an electric drive motor 2, such as, e.g., a reversing electric motor with a motor shaft and a gear worm, which interacts only with the functional element 3.

In the stop position 4 shown in this drawing, there is a frictional contact between the functional element 3 and the frictional element 6, wherein the frictional element 6 is integrated, e.g., into the housing 12 and is a part of the housing 12. It should be recognized that the functional element 3 is already in contact with the frictional element 6 before the functional element has actually reached the stop position 4. Following the schematic view shown in FIG. 1 are additional embodiments.

Figure 2:
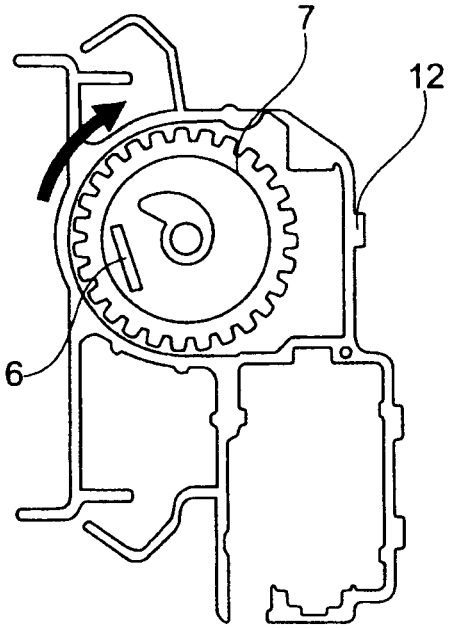
FIG. 2 shows a first embodiment of the invention beyond the stop position.
Figure 3:
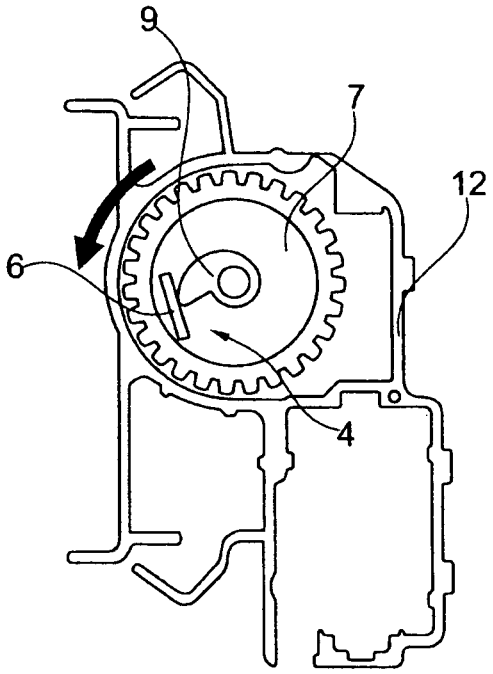
FIG. 3 shows the embodiment of FIG. 2 in the stop position.

In FIGS. 2 and 3, the drive motor has been omitted to better illustrate the housing 12, which forms the frictional element 6, together with the functional element configured as a rotational member 7. FIG. 2 shows a position of the rotational member 7 component in which the rotational member is actuatable and does not impose self-restraint (it is freely actuatable). In this embodiment, the frictional element 6 is implemented as a straight running molded rib made of plastic. FIG. 3 shows that the rotational member 7 has a projection 9 formed as a radial cam, which moves against the rib (frictional element 6) formed on the lock housing to avoid return movements. Thus, the stop position 4 is secured when the drive unit 1 is switched off.

Figure 4:
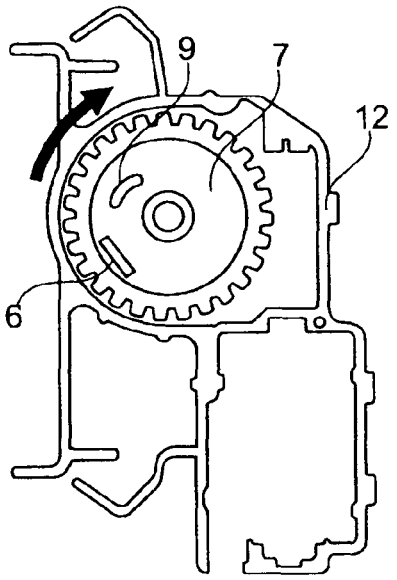
FIG. 4 shows a second embodiment of the invention beyond the stop position.
Figure 5:
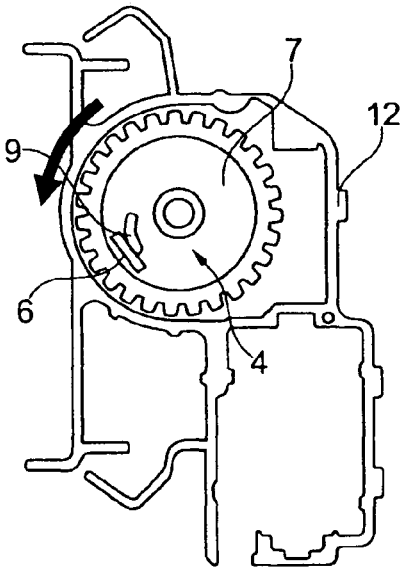
FIG. 5 show the embodiment of FIG. 6 in the stop position.

FIGS. 4 and 5 show a further embodiment in which a cam-shaped elevation is formed as the projection 9 in the axial direction on the back of the rotational member 7. The projection 9 strikes a gradually increasing slope (ramp) implemented as a frictional element 6 in the housing 12 such that the rotational member 7 is slowed down and its motion is finally blocked when the drive unit 1 is turned off (i.e., not powered). Hence, in particular, various frictional forces can be achieved during the rotational movement of the rotational member 7.

Figure 6:
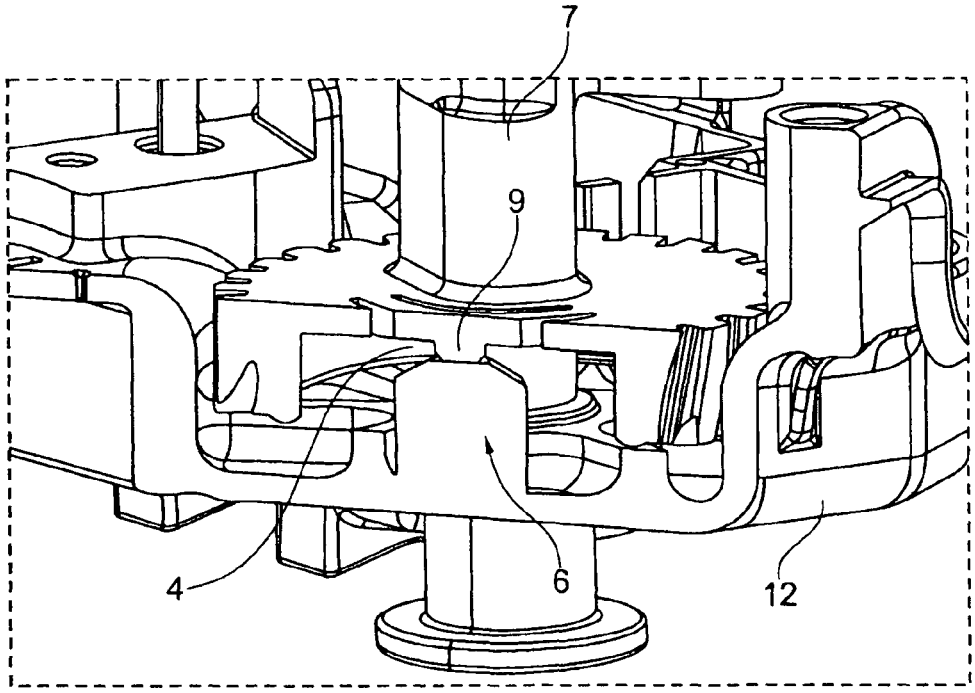
FIG. 6 shows a perspective sectional view of another embodiment of the invention in the stop position.
Figure 7:
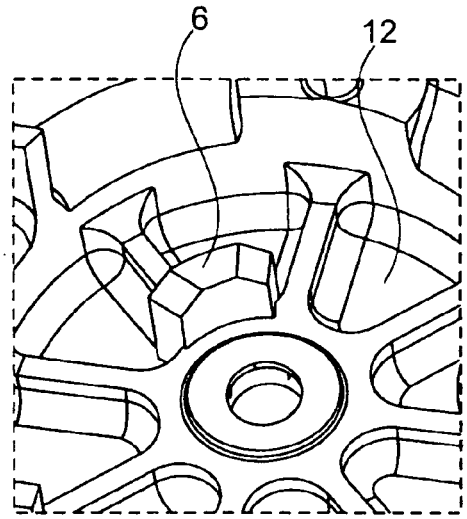
FIG. 7 shows, in plan view, a detail of the housing of FIG. 6.
Figure 8:
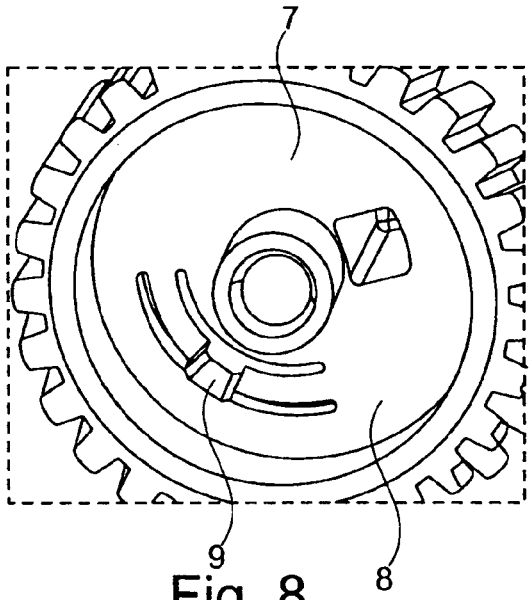
FIG. 8 shows a side view of the rotational member from FIG. 6.

FIGS. 6, 7, and 8 illustrate yet another embodiment of the invention. In this embodiment, the rotational component 7 is provided with a projection 9, which runs up to the housing 12, wherein the projection 9 is implemented as a spring element of the rotational member 7. The projection 9 extends out to the side surface 8 of the rotary device 7 and can interact with a wedge-shaped projection formed as the frictional element 6 in the housing 12. Whereas the contact force in the previously described embodiments was generated tangentially to the circumferential direction of the rotational component, here, the contact force is achieved in the axial direction.

Figure 9:
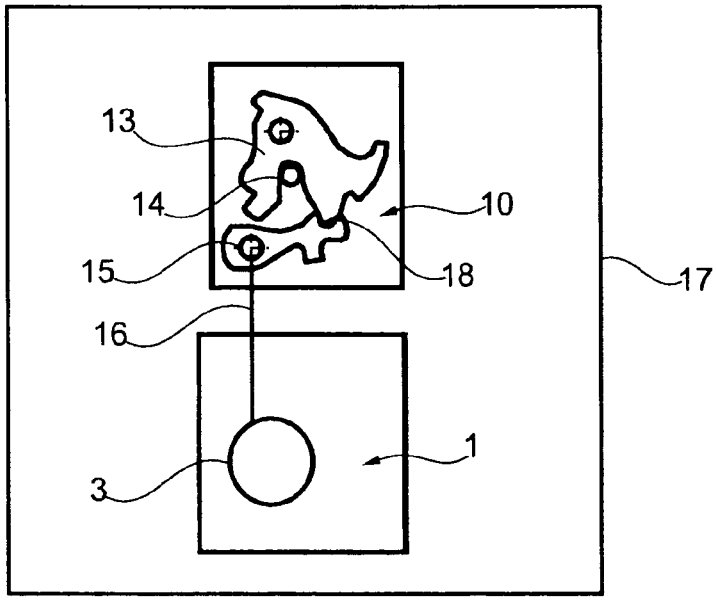
FIG. 9 shows a motor vehicle with a drive unit that acts on a pawl of a locking latch.

FIG. 9 shows a schematic diagram of a motor vehicle 17 with a motor vehicle lock 10. Such a motor vehicle lock 10 normally comprises a catch 13, which comprises at least one rest 18. The catch 13 blocks in the closed position a locking bolt 14 (also called a latch pin) that can be attached, for example, on a vehicle body (not shown here). Here, the catch 13 engages the pawl 15, which secures the catch 13 at the resting position 18 by positive engagement so as to prevent rotation.

Furthermore, the motor vehicle 17 comprises an electric motor drive unit 1. The functional element 3 of the drive unit 1 acts here via an indicated ratchet mechanism 16 on the pawl 15 of the motor vehicle lock 10. This allows the catch 15 to be moved by the drive unit 1 about a rotation axis of the pawl 15, whereby, for example, the catch 13 may be unlocked.

Figure 10:
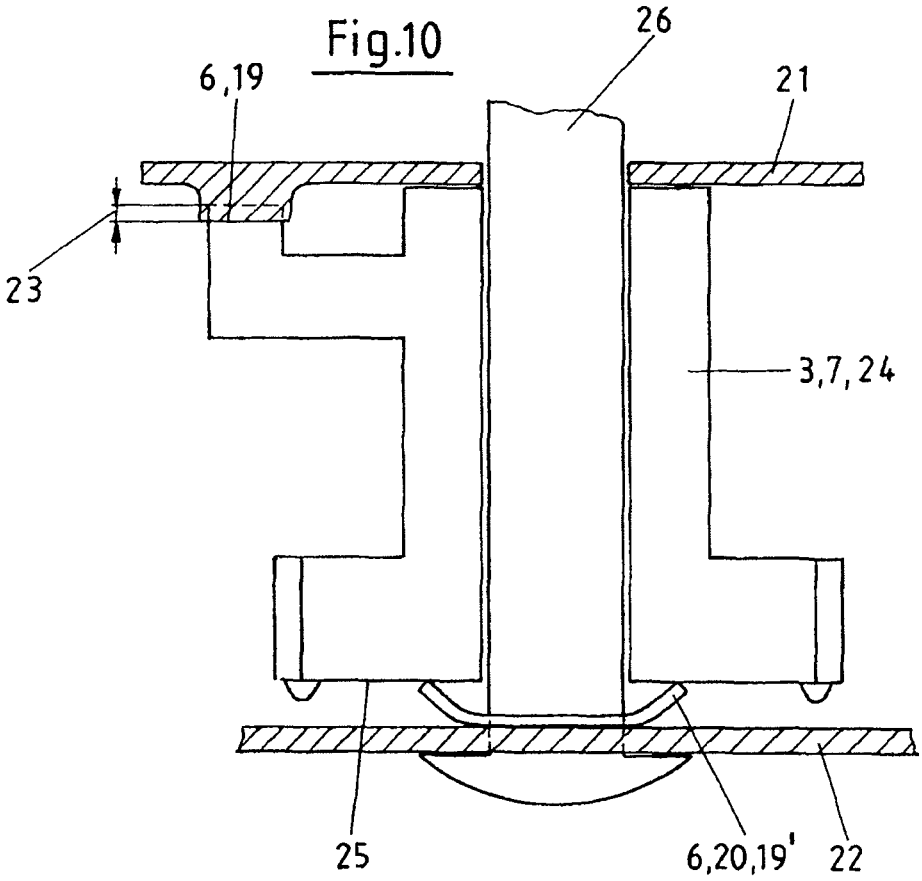
FIG. 10 shows a side view of an embodiment of a spring washer and a frictional element integrated into the housing.

FIG. 10 shows an embodiment with two frictional elements 6, one of which, 19, is disposed above the rotational component 7 and the other of which, 19', is disposed below the rotational component 7. The first frictional element 19 is integrated into the lid 21 of the housing 12. The frictional element 19 and the lid 21 are made as a single piece. The reference numeral 23 is assigned to an overlap between the rotational member 7 formed as a worm gear to illustrate that corresponding frictional forces can be exerted at this location. In addition, the frictional element 19', provided in the form of a spring washer 20, is located at the bottom 25 of the rotational member 7. The system can be designed such that it can be permanently operated against the frictional force exerted by the spring washer 20 so that resetting forces can be preferably avoided when the drive is turned off. The spring washer 20 is penetrated by the shaft 26 and is supported on the one hand by the rotational member 7 and on the other by the bottom 22 of the housing 12.

Figure 11:
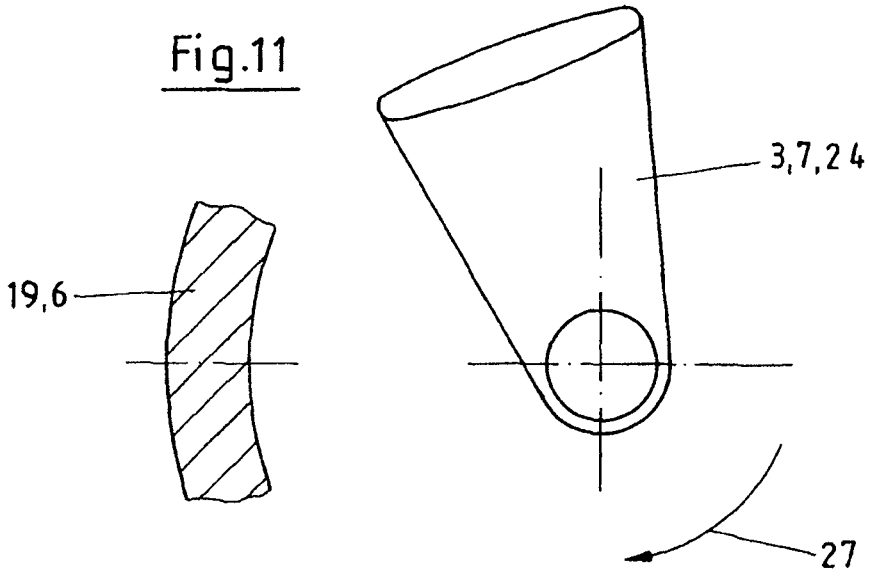
FIG. 11 shows a sketch thereof.

A simplified sketch in FIG. 11 shows the worm wheel 24 rotating in the direction 27 and the frictional element 6, 19 is provided in addition to the frictional element for the rotational member 7, shown in FIG. 10.

The invention claimed is:

1. A drive unit for a central locking system that locks and unlocks a catch in a lock of a vehicle so that the catch cannot and can be moved from a closed position to an open position, comprising a housing, an electric drive motor mounted to the housing for moving a functional element between a stop position for preventing opening movement of the catch and a release position for enabling opening movement of the catch, and at least one frictional element cooperating with the functional element to provide frictional resistance to movement of the functional element, wherein the frictional element is disposed in the housing along a motion pathway of the functional element before the functional element reaches the stop position, and wherein the friction coefficient between the frictional element and the functional element is such that the frictional force between the functional element and the frictional element cannot be overcome by forces that normally act on the functional element when the drive motor is turned off when the functional element is in the stop position.

2. The drive unit of claim 1, wherein the functional element (3) is a rotational member.

3. The drive unit of claim 2, wherein the frictional element is disposed at a side surface of the rotational member.

4. The drive unit of claim 1, wherein the frictional element frictionally engages a lateral projection of the functional element.

5. The drive unit of claim 4, wherein the lateral projection is selected from the following group: a rib, a cam, a wing, or a beam with a recess.

6. The drive unit of claim 1, wherein the at least one frictional element is disposed below and/or above of the rotational member.

7. The drive unit of claim 6, wherein the frictional element is a spring washer.

8. The drive unit of claim 1, wherein the at least one frictional element includes two separate frictional elements.

9. The drive unit of claim 1, wherein the frictional element is integrated into the housing.

10. The drive unit of claim 9, wherein the frictional element is integrated into the lid and/or the bottom of the housing.

11. A method for triggering a mechanism for unlocking a motor vehicle lock that includes a catch for engaging and releasing a locking bolt, wherein the drive unit of claim 1 acts on a component of the motor vehicle lock to prevent or permit opening movement of the catch.

12. A motor vehicle lock assembly including a motor vehicle lock that includes a catch for engaging and releasing a locking bolt, and the drive unit of claim 1.

13. The motor vehicle lock according to claim 12, wherein the motor vehicle lock is implemented as an electrically-openable lock.

14. The motor vehicle lock according to claim 12, wherein the motor vehicle lock is implemented as a side-door lock.

15. The drive unit of claim 1, wherein the functional element is a rotational member that is rotatably driven by a worm gear that is rotatably driven by the motor.

16. The drive unit of claim 15, wherein the rotational member interacts with a locking lever movable between a first position that enables opening movement of the catch and a second position that prevents opening movement of the catch.

* * * * *